United States Patent [19]

Page, Jr.

[11] 4,350,080

[45] Sep. 21, 1982

[54] APPARATUS TO PUMP MULTIPLE WELLS

[76] Inventor: John S. Page, Jr., 21372 Brookhurst St., No. 312, Huntington Beach, Calif. 92646

[21] Appl. No.: 216,802

[22] Filed: Dec. 16, 1980

[51] Int. Cl.[3] ..... F15B 11/16; F15B 13/06

[52] U.S. Cl. ..... 91/520; 91/39; 91/536; 91/470

[58] Field of Search ..... 91/39, 152, 159, 180, 91/520, 536; 92/137

[56] References Cited

U.S. PATENT DOCUMENTS

| | | | |
|---|---|---|---|
| 510,116 | 12/1893 | Carlson | 91/536 |
| 1,848,736 | 3/1932 | Mason | 92/137 |
| 4,241,641 | 12/1980 | Reinert | 91/520 |
| 4,243,106 | 1/1981 | Skubich et al. | 91/520 |

FOREIGN PATENT DOCUMENTS

| | | | |
|---|---|---|---|
| 682668 | 8/1979 | U.S.S.R. | 92/137 |

*Primary Examiner*—Paul E. Maslousky

*Attorney, Agent, or Firm*—William W. Haefliger

[57] ABSTRACT

A pumping unit pumps two wells, simultaneously, to save energy and space, weight of one rod string offsetting weight of the other string.

8 Claims, 4 Drawing Figures

APPARATUS TO PUMP MULTIPLE WELLS

BACKGROUND OF THE INVENTION

This invention relates generally to the pumping of wells, and more particularly concerns the pumping of multiple wells in such manner as to achieve energy savings.

Sucker rod strings are typically reciprocated up and down in oil wells during pumping of such wells. Ordinarily, considerable energy is expended each time the rod string is lifted, due to the weight of the string and liquid imposed on the pumping apparatus. There is need to reduce this energy consumption, and to simplify the pumping requirements. Also there is need to reduce the space required for surface apparatus elevating and lowering the rod strings, and particularly on off-shore platforms.

SUMMARY OF THE INVENTION

It is a major object of the invention to provide a means for meeting the above described needs through pumping of multiple wells in a manner that takes advantage of and provides for balancing the rod string loads or weight, in the wells. Fundamentally, these objectives are achieved through provision of:

(b) means at the well surface operatively interconnecting the two rod strings for balancing loading imposed by said strings, and (b) said means operatively connected via said structure with said strings to lift one string while the other string is lowered, and to lift the other string while said one string is lowered.

As will appear, the described means may comprise fluid or hydraulic apparatus employing multiple pistons and cylinders at the well head, the pistons for example supporting the rod strings in multiple wells and being raised and lowered in alternation by hydraulic pressure. Alternatively, the means may comprise a walking beam with means at opposite end portions of the beam connected to rod strings in different wells. Only one drive means rocks the walking beam, yet two wells for example are thereby pumped by the beam, saving energy and space.

These and other objects and advantages of the invention, as well as the details of an illustrative embodiment, will be more fully understood from the following description and drawings, in which:

DRAWING DESCRIPTION

DETAILED DESCRIPTION

Figure 1:
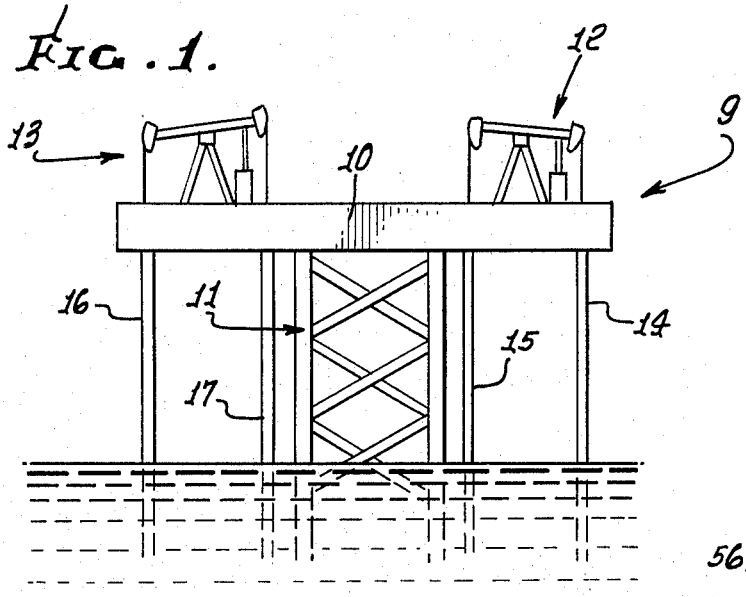
FIG. 1 is an elevation showing a drilling platform with pumping apparatus thereon.

In FIG. 1, an offshore structure 9 includes a platform 10 supported at 11. On the platform are pumping units 12 and 13. Unit 12 is constructed to pump well fluid in two wells, indicated by casings 14 and 15; and unit 13 is constructed to pump well fluid in two wells, indicated by casings 16 and 17. Substantial space is saved, where space is at a premium, due to the provision and in those instances of single apparatus pumping two or more wells.

Figure 2:
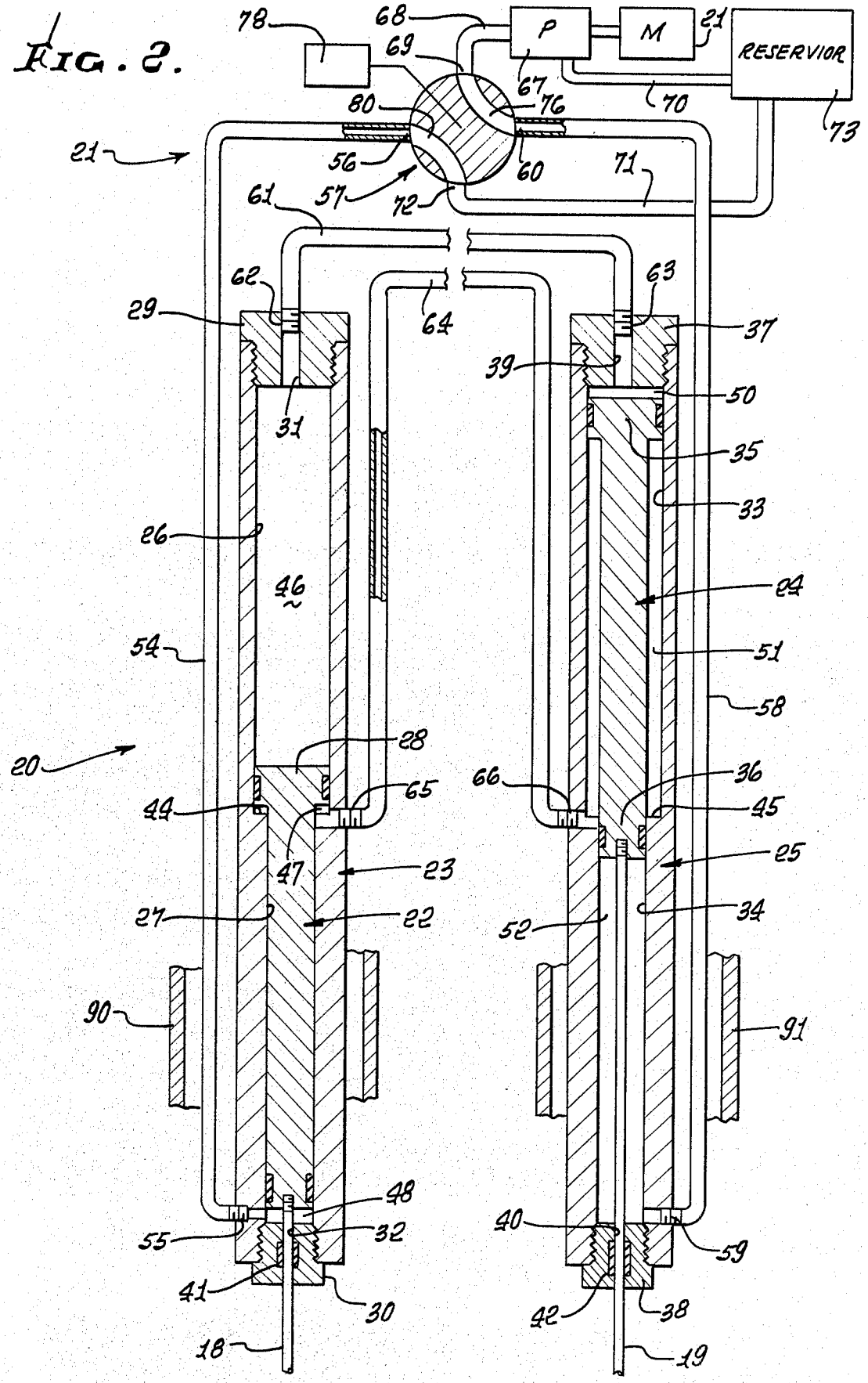
FIG. 2 is an enlarged elevation showing details of pumping apparatus seen in FIG. 1.

Extending the description to FIG. 2, the apparatus 12 pumps the two wells via two rod strings in the respective wells, examples of such strings being indicated at 18 and 19. Structural means 20 at the well surface is operatively connected with the two strings for balancing loading imposed by the strings. Means, as at 21 is operatively connected, via structure 20, with the two strings 18 and 19 to lift one string while the other is lowered, and to lift the other string while the one string is lowered.

As shown, the means 20 includes first piston and cylinder elements, as for example at 22 and 23, associated with one rod string, and second piston and cylinder elements as at 24 and 25 for example, associated with the other rod string. Typically, the piston elements 22 and 24 are connected with the two strings, as shown, and move up and down relative to the cylinder elements 23 and 25. The first cylinder 23 is vertically elongated and forms an upper bore 26 and a lower bore 27, the upper bore having a larger internal diameter than the lower chamber. The first piston 22 has an upper portion 28 slidably reciprocating in the upper bore, and a lower portion slidably reciprocating in the lower bore. Caps 29 and 30 close the opposite ends of the cylinder, excepting that upper cap 29 is ducted at 31, and the lower cap is ported at 32 and sealingly passes the rod 18. In similar manner, second cylinder 25 forms upper and lower bores 33 and 34 within which upper and lower portions 35 and 36 of second piston 24 slidably reciprocate. Caps 37 and 38 are respectively ducted at 39, and ported at 40 to sealingly pass rod 19. Note seals 41 and 42.

Also, the piston upper portions or heads, being of larger diameter, can seat at step shoulders 44 and 45 formed between the different diameter bores 28 and 27, and 33 and 34 of the two cylinders. Each cylinder includes three pressure chambers, i.e. cylinder 23 includes upper chamber 46 above piston 28, intermediate chamber 47 below piston 28 but above shoulder 44, and lower chamber 48 below piston 29. Cylinder 25 includes upper chamber 50 above piston 35, intermediate chamber 51 below piston 35 but above shoulder 45, and lower chamber 52 below piston 36.

The referenced actuating means includes an hydraulic system interconnecting the first piston and cylinder elements with the second piston and cylinder elements so that hydraulic pressure acts alternately to lift one of the first elements and then one of the second elements. Typically, the system includes primary ducting connected with the two cylinders 23 and 25 for alternately supplying hydraulic fluid pressure to the two lower chambers 48 and 52; secondary ducting interconnecting the upper chambers 46 and 50; and tertiary ducting interconnecting the intermediate chambers 47 and 51. As shown, the primary ducting includes duct 54 connected at 55 to lower end of cylinder 23 and at 56 with valve 57; and duct 58 connected at 59 to the lower end of cylinder 25 and at 60 with valve 57. The secondary ducting is shown as duct 61 connected at 62 and 63 with end caps 29 and 37 and ports 31 and 39 therein; and the tertiary ducting includes duct 64 connected at 65 and 66 with the cylinder to communicate with chambers 47 and 51.

A pump 67, driven by motor 21, supplies pressurized hydraulic fluid via line 68 to valve port 69, and a reservoir 73 supplies fluid via line 70 to the pump inlet. Exhaust duct 71 extends from the valve port 72 to the reservoir 73.

In operation, the four-way valve 57 has one position (as shown) in which pressurized fluid flows via valve passage 76 and duct 58 to lower chamber 52 to elevate piston 24 to the top of its stroke, as shown. Fluid above piston 24 in chamber 50 is forced via line 61 to chamber 46 above piston 22, which is driven down. The lower chamber 48 below piston 22 is thereby exhausted as via exit fluid flow via duct 54, valve passage 80 and line 71 to the reservoir 73. A switching device 78 then rotates the valve 57 to second position to connect passage 76 between 69 and 56, and to connect passage 80 between 72 and 60. Flow pressure is then directed via duct 54 to chamber 78 to elevate the piston 22. During this time, fluid above piston 22 is forced via line 61 to chamber 50 above piston 24, which is driven down. The lower chamber 52 below piston 24 is thereby exhausted as via exit flow via duct 58, valve passage 80 and line 71 to the reservoir.

Further, the weight of the rods is supported by the fluid trapped in the closed sub-system that includes chambers 47 and 51, and duct 64 that interconnects them.

One advantage of this system is that it requires much less working surface area than a walking beam unit. Also, it can be submerged into the well casing, eliminating unsightly surface units. See for example the casing indicated at 90 and 91. On offshore platforms surface space is at a premium and in residential areas a hidden unit is often required by a city ordinance. This described system also provides the advantages of low cost rod pumping economics as it will require 50 to 60% less energy to produce the well because the rod strings of both wells do not have to be lifted with energy expenditure that is wasted as the string is lowered. In the described system, one string is balanced by the other string.

Figure 3:
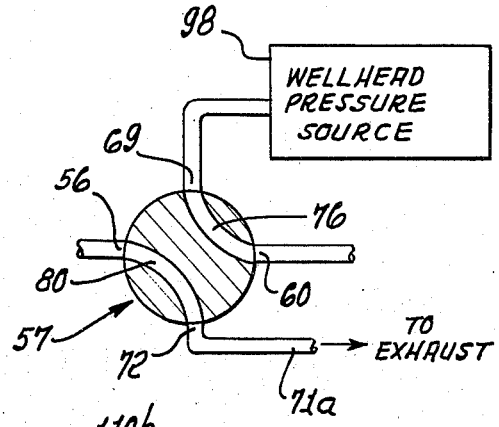
FIG. 3 is a diagram showing substitution of well pressure in the FIG. 2 apparatus.

Another form of this invention is to remove the pump, motor and reservoir, shown in FIG. 2, and substitute flow pressure from other oil or gas wells that are passing through nearby flow lines to and through the four way valve and through the system and then exhausted on down stream to the original destination or compressor plant. FIG. 3 shows the valve 57 having its inlet port 69 connected to the well fluid pressure source 98, i.e. from another oil or gas well. Fluid exhausted via port 72 flows via line 71*a* to exhaust.

Figure 4:
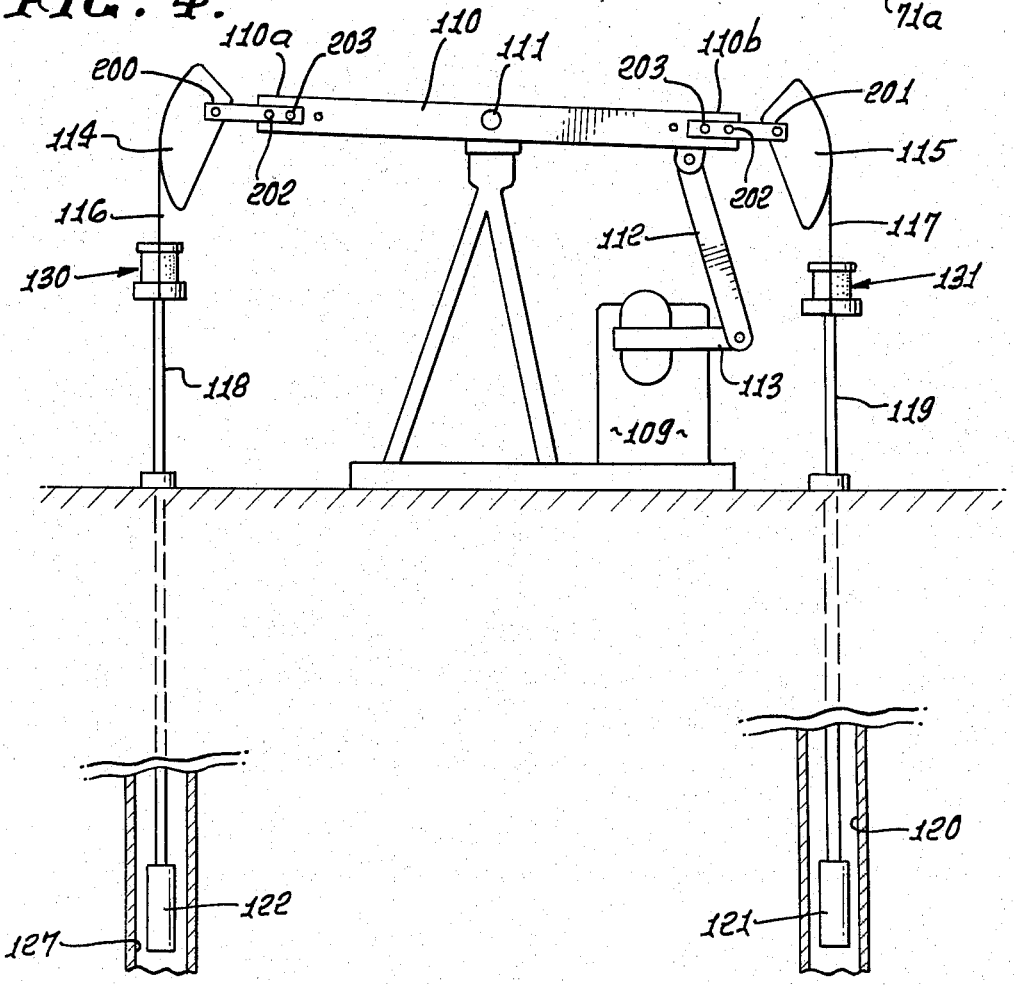
FIG. 4 is another elevation showing details of alternate pumping apparatus.

In the form of the invention shown in FIG. 4, a walking beam 110 is pivotally supported at 111, and a rotary drive 109 rocks the beam via linkage connection 112 to crank arm 113. Horseheads 114 and 115 at opposite ends of the beam support reins or cables 116 and 117. Cables 116 are connected to a pumping rod string 118 in well 127, and cables 117 are connected to a pumping rod string 119 in well 120. Sub-surface pumps are indicated at 121 and 122.

The rod weight in one well is approximately balanced by the rods in the other well. On off-shore platforms, this double pumper saves valuable space. Balancing weights on the drive would only be needed if one well was deeper than the other well. Another advantage is that only one motor and one gear box are wearing. A saving of energy consumption is achieved because the unit primarily lifts fluid, i.e. no weights (if the well depth and pump size were the same) and no rods.

In a conventional pumping unit the weight of the rods and the weight of the fluid must be lifted, and if there were no counter balance weight, the unit could not pump unless it were extremely over powered. If the weight of the rods were 8000 lbs and the weight of the fluid were 6000 lbs for a total of 14,000 lbs, about 7000 lbs of counter balance weights are used, so that the motor is pulling an even 7000 lbs on both the down stroke (when it is lifting the weights) and 7000 lbs when it is lifting the rods and fluid, but with 7000 lbs of weights to assist.

With applicant's unit, only the weight of the fluid will be lifted which would amount to 55% to 60% or 65% saving in electricity.

Shock absorbing cushion means may also be connected in series with cables 116 and 117. See cushion 130 and 131, and applicant's application Ser. No. 186,499, filed Sept. 12, 1980.

Also shown in FIG. 4 are extension bars 200 and 201 which adjustably interconnect the horseheads 114 and 115 with the walking beam extents 110*a* and 110*b*, respectively. Note the bolts 202 and 203 which extend through openings in the bars and the beam. Such removable or adjustable interconnection allows the provision of more unobstructed space above either of the wells during pulling of tubing from a well. For example, while tubing is being pulled from well 117, extension bar 200 is removed from the walking beam, so that horsehead 114 no longer projects above well 117. Meanwhile, the walking beam may be operated to pump well 120.

I claim:

1. In well pumping apparatus adapted to pump two wells via two rod strings in the respective wells and pumping means operated in the wells by the strings, the combination comprising:

(a) means at the well surface operatively interconnecting the two rod strings for balancing loading imposed by said strings, (b) said means operatively connected with said strings to lift one string while the other string is lowered, and to lift the other string while said one string is lowered, (c) said means including (x) first piston and cylinder elements associated with one rod string, one of said first elements being connectible with said first rod string, and (y) second piston and cylinder elements associated with the other rod string, one of said second elements being connectible with the second rod string, (d) said means including an hydraulic system interconnecting said first elements with said second elements so that hydraulic pressure acts alternately to lift one of the first elements and then one of the second elements, said means also including an hydraulic fluid pump connected with said hydraulic system via valving having one position in which pumped fluid pressure acts to elevate said one of the first elements, and another position in which pumped fluid pressure acts to elevate said one of the second elements, and said hydraulic system including (i) primary ducting connected with said cylinder elements for alternately supplying fluid pressure to lower chambers defined by said piston and cylinder elements, (ii) secondary ducting interconnecting upper chambers defined by said piston and cylinder elements, and (iii) tertiary ducting interconnecting intermediate chambers defined by said piston and cylinder elements.

2. The combination of claim 1 including said rod strings connected with certain ones of said elements.

3. The combination of claim 1 wherein said one of the first and second elements each comprises a piston.

4. The combination of claim 1 wherein one of the first and second elements each comprises a piston, and the other of the first and second elements each comprises a cylinder.

5. The combination of claim 4 wherein each cylinder is vertically extended, each upper chamber having a larger internal diameter than the associated lower chamber, and each piston has an upper portion reciprocating in one of the upper chambers and a lower portion reciprocating in one of the lower chambers.

6. The combination of claim 1 wherein said valving communicates with said primary ducting to alternately supply fluid pressure to said lower chambers, in said one and said other positions of the valving, respectively.

7. The combination of claim 6 wherein said pump has one output connected with said valving, and an input connected with a fluid reservoir which is supplied with fluid via said valving.

8. The combination of claim 1 wherein fluid trapped in said intermediate chambers supports the piston and the rod strings suspended therefrom.

* * * * *